US006669106B2

(12) United States Patent
Delcea

(10) Patent No.: US 6,669,106 B2
(45) Date of Patent: Dec. 30, 2003

(54) AXIAL FEEDSTOCK INJECTOR WITH SINGLE SPLITTING ARM

(75) Inventor: Lucian Bogdan Delcea, Port Coquitlam (CA)

(73) Assignee: Duran Technologies, Inc., British Columbia (CA)

( * ) Notice: Subject to any disclaimer, the term of this patent is extended or adjusted under 35 U.S.C. 154(b) by 354 days.

(21) Appl. No.: 09/912,329

(22) Filed: Jul. 26, 2001

(65) Prior Publication Data

US 2003/0019947 A1 Jan. 30, 2003

(51) Int. Cl.[7] ..... B05B 1/24; B05C 5/04

(52) U.S. Cl. ..... 239/79; 239/80; 239/81; 239/423; 239/DIG. 7; 219/76.16; 219/121.5

(58) Field of Search ..... 239/79, 80, 81, 239/418, 423, 424, 432, 590, 590.3, DIG. 7; 219/121.47, 121.5, 76.15, 76.16

(56) References Cited

U.S. PATENT DOCUMENTS

| | | | | |
|---|---|---|---|---|
| 3,140,380 A | | 7/1964 | Jensen | |
| 3,312,566 A | | 4/1967 | Winzeler et al. | |
| 4,330,086 A | * | 5/1982 | Nysted | 239/432 |
| 4,416,421 A | | 11/1983 | Browning | |
| 4,504,014 A | * | 3/1985 | Leuning | 239/DIG. 7 |
| 4,509,694 A | * | 4/1985 | Inculet et al. | 239/697 |
| 4,540,121 A | | 9/1985 | Browning | |
| 4,780,591 A | | 10/1988 | Bernecki et al. | |
| 4,990,739 A | | 2/1991 | Zaplatynsky | |
| 5,008,511 A | | 4/1991 | Ross | |
| 5,225,652 A | | 7/1993 | Landes | |
| 5,332,885 A | | 7/1994 | Landes | |
| 5,406,046 A | | 4/1995 | Landes | |
| 5,420,391 A | | 5/1995 | Delcea | |
| 5,556,558 A | | 9/1996 | Ross et al. | |
| 5,837,959 A | | 11/1998 | Muehlberger | |
| 6,114,649 A | | 9/2000 | Delcea | |
| 6,202,939 B1 | | 3/2001 | Delcea | |
| 6,392,189 B1 | | 5/2002 | Delcea | 219/121.5 |
| 6,425,531 B1 | * | 7/2002 | Nielsen | 239/DIG. 7 |

OTHER PUBLICATIONS

Future Power Systems Group (MLW's Team), Current Research Projects, Coanda Effect, Internet Page, Jun. 24, 1999.

Sulzer Metco, Metco 320 NS–Abradable Powder, (Specification Sheet).

National Advisory Committee for Aeronautics, Technical Note 4377, Washington, 1958, pp. 1,2,26.

Robert W. Fox, Alan T. McDonald, Introduction to Fluid Mechanics, Third Edition, John Wiley & Sons, 1985 pp 454–475.

* cited by examiner

*Primary Examiner*—Robin O. Evans
(74) *Attorney, Agent, or Firm*—Bull, Housser & Tupper

(57) ABSTRACT

A feedstock injector for connection to a source of heated gas comprises a converging channel extending from the upstream end to the downstream end of the injector. A splitting arm extends diagonally within the converging channel, the splitting arm comprising two symmetrically opposed surfaces extending from the inlet to the outlet ends of the converging channel. A feedstock injection passage opens axially at the downstream end of the splitting arm. The gas stream discharged by the injector contacts and entrains the feedstock with improved uniformity.

25 Claims, 6 Drawing Sheets

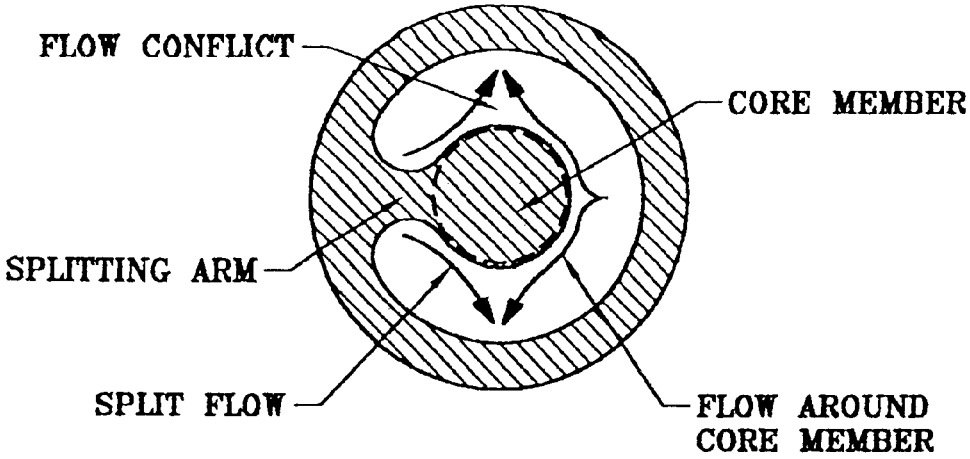
FIG. 1
PRIOR ART
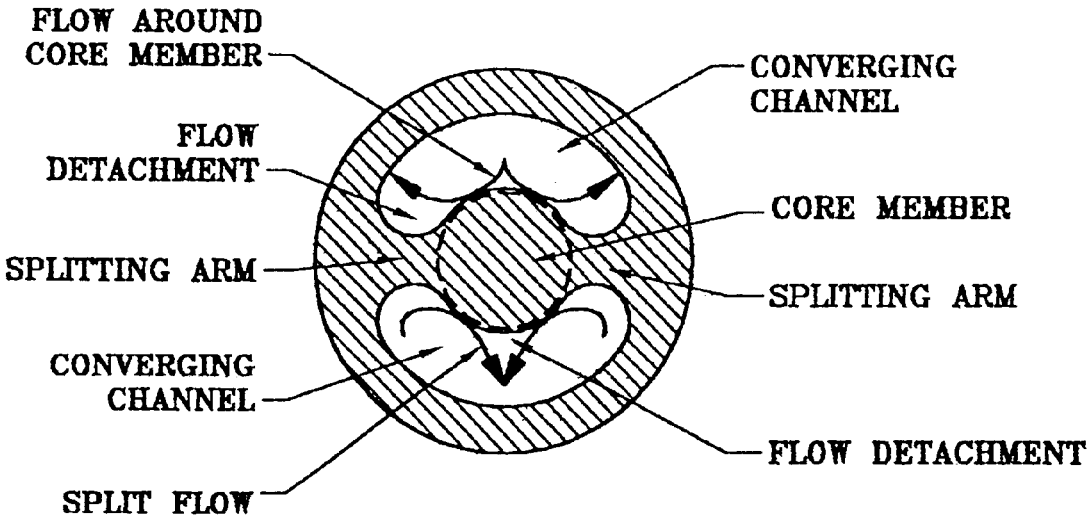
FIG. 2.1
PRIOR ART

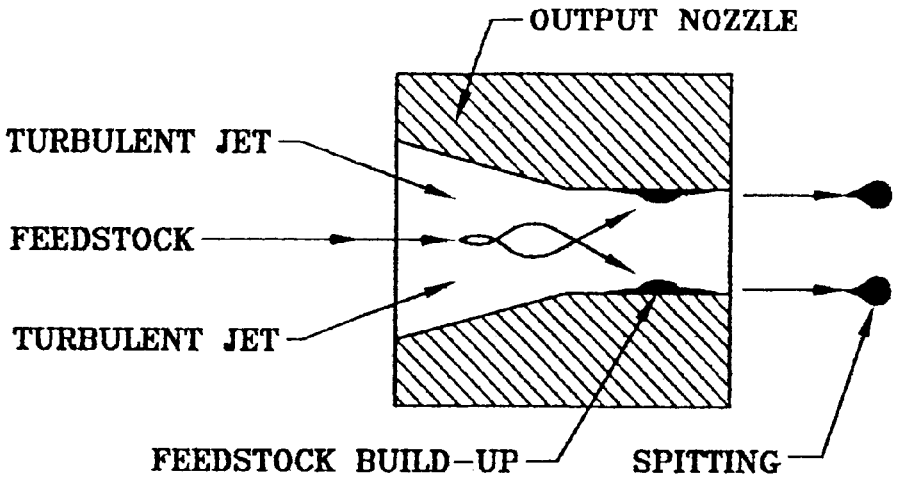
FIG. 2.2
PRIOR ART
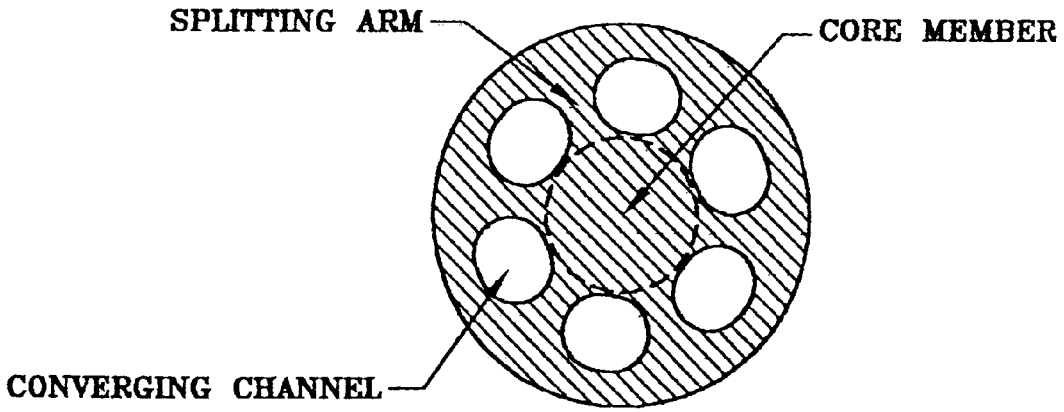
FIG. 2.3
PRIOR ART

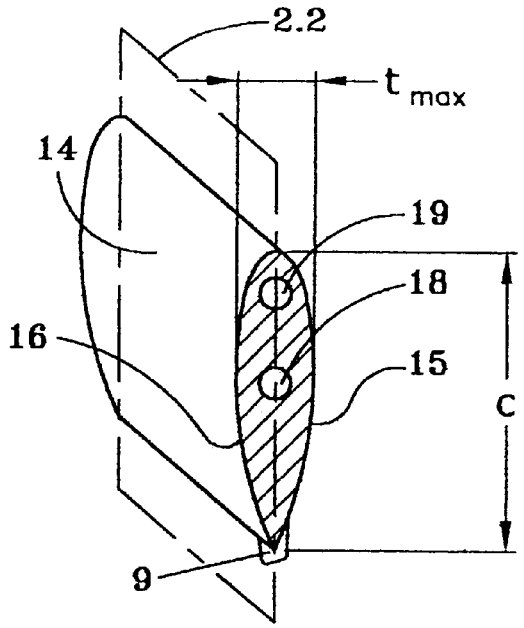
FIG. 5.1
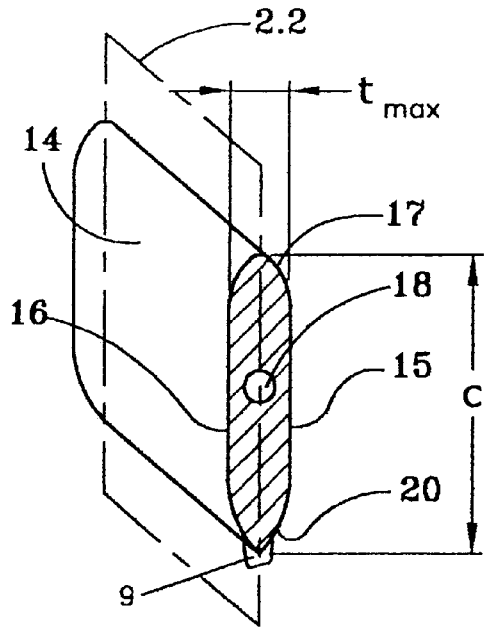
FIG. 5.2
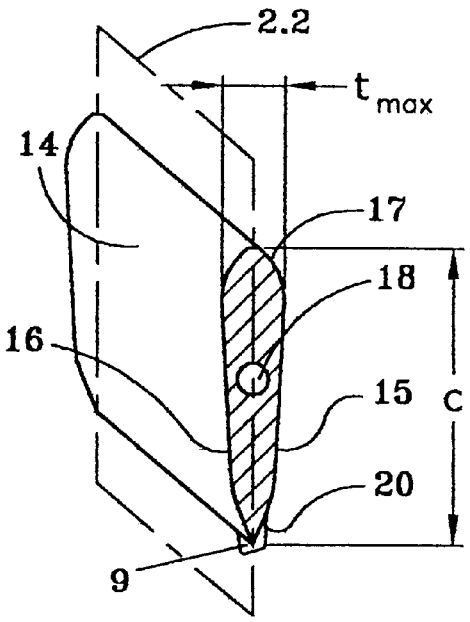
FIG. 5.3
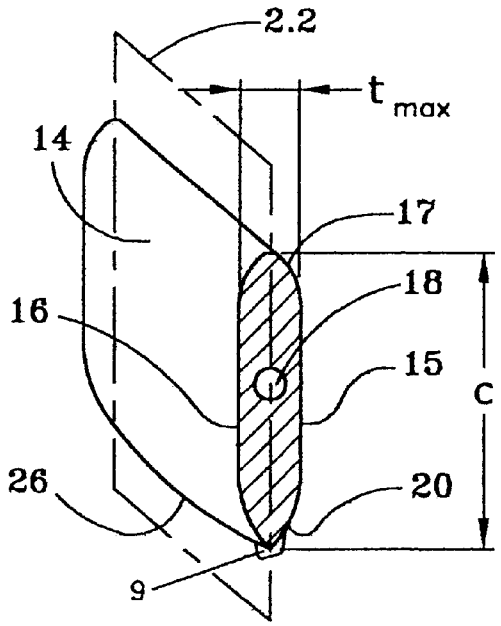
FIG. 5.4

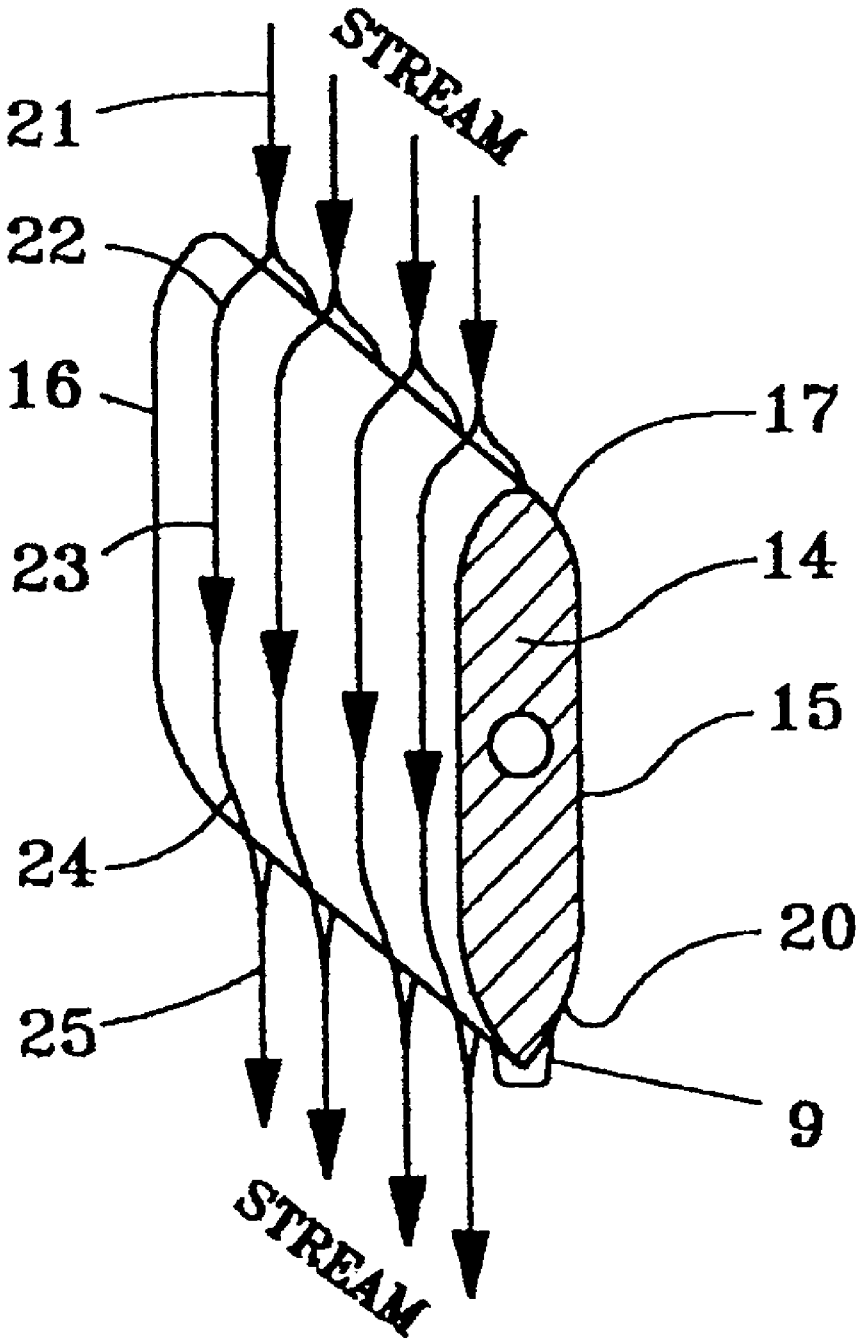
FIG. 5.5

AXIAL FEEDSTOCK INJECTOR WITH SINGLE SPLITTING ARM

FIELD OF THE INVENTION

This invention relates to an injector used for feeding feedstock material into the axis of a jet of heated gas.

BACKGROUND OF THE INVENTION

Thermal spraying is a coating method wherein powder or other feedstock material is fed into a stream of heated gas produced by a plasmatron or by the combustion of fuel gasses. The feedstock is entrapped by the hot gas stream from which it is transferred heat and momentum and it is impacted onto a surface where it adheres and solidifies, forming a relatively thick thermally sprayed coating by the cladding of subsequent thin layers or lamellae.

In the case of some thermal spray applications, injecting feedstock axially into a heated gas stream presents certain advantages over traditional methods wherein feedstock is fed into the stream in a direction generally described as radial injection, in other words in a direction towards the axis of the gas stream. The advantages of the axial injection relate mainly to the potentitto control better the linearity and the direction of feedstock particle trajectory and to increase its velocity. However, this has been accomplished in the past by interposing a core element through which feedstock is injected axially. Although the fundamental principle of wrapping a gas flow around a core member appears to be a desirable way of achieving axial injection, in practice the core causes significant turbulence of the gas stream. It would be therefore desirable to inject feedstock in a manner that achieves an optimal particle trajectory in the axial direction by inducing minimal turbulence of the gas stream.

Plasma torches with axial injection of feedstock can be classified in two major groups: a) those with multiple cathodes, also known as the pluri-plasmatron or the multiple-jet type and b) those with single cathode, also known as the single jet or single electrode type.

Examples of multiple cathode plasma torches with axial injection are found in U.S. Pat. Nos. 3,140,380 of Jensen, 3,312,566 of Winzeler et al., 5,008,511 of Ross and 5,556,558 of Ross et al. They show a plurality of plasmatrons symmetrically arranged about the axis of the plasma spray torch and provide for nozzle means to converge the plurality of plasmas into a single plasma stream. Feeding means are also provided to inject feedstock materials along the axis of the single plasma stream. This type of plasma torches involve complex torch configurations with increased chances of malfunctioning and require the use of multiple power supplies for powering the multiple cathodes. The use of multiple cathodes and multiple arc chambers, which need to be replaced regularly, induce high operating costs for such plasma torches. A different approach to achieve axial injection employing multiple cathodes and a complex single arc chamber configuration is found in U.S. Pat. Nos. 5,225,652, 5,406,046 and 5,332,885, all three issued to Landes.

The single cathode type plasma torches with axial injection have certain advantages over multiple cathodes systems such as less complex torch configuration and reduced operating and manufacturing costs. Typical arrangements for the single cathode approach are found in U.S. Pat. Nos. 4,540,121 of Browning, 4,780,591 of Bemecki et al., 5,420.391 of Delcea, 6,202,939 of Delcea and 5,837,959 of Muehlberger et al.

U.S. Pat. No. 4,780,591 of Bemecki et al. teaches the semi-splitting of the plasma stream by means of a core member positioned axially within the feedstock injector and a plasma splitting arm which extends from the core to the injector internal wall, defining a "C" shaped plasma channel. The feedstock is injected axially through the core member. As shown in FIG. 1 of the drawings, this approach creates an asymmetrical plasma stream flow within the injector, with a portion of the plasma stream going around the core member, while the arm splits the other portion of the stream. Apart for the obvious asymmetry, this particular type of flow dynamics creates a flow conflict that induces asymmetrical jet turbulence.

U.S Pat. No. 5,420.391 of Delcea also teaches a core member positioned axially but instead of providing only one arm as in Bernecki '591, two or more splitting arms now extend from the core member to the outer walls, defining kidney-shaped plasma channels arranged symmetrically around the core, as shown in FIG. 2.1. This arrangement allows the symmetrical wrapping of the gas flow around the core member. Similarly, U.S. Pat. No. 5,556,558 of Ross teaches kidney shaped plasma channels arranged in an encircling relationship around a core member but instead of splitting a single plasma stream, Ross provides for independent plasma jets for each of the plasma channels. Inherent to the design in Delcea '391 and in particular when only two plasma channels are provided, each channel has plasma-shaping walls defining essentially a kidney-shaped cross-section in order to accommodate either a cylindrical or a conical core member between the channels. A plasma torch having a single gas stream with circular cross-section flowing around a central core member suffers two fluid mechanic transformations while passing through the internal pathways of the injector, i.e. firstly the splitting of the stream into a plurality of streams around the core and secondly the volumetric transformation as each of the split streams conforms to the shape of the kidney shaped channels encircling the core member. When leaving the injector, the split streams must be merged smoothly into a single stream having again an essentially circular cross-section. The region where the split streams merge (which is also the region where the feedstock is injected into the stream) becomes quite turbulent, causing non-axial feedstock trajectories within the merged stream. According to fluid mechanics theory, turbulence is generated inside each of the splitting channels due to gas flow separation occurring along the walls of the core and of the channel cavities adjacent to each splitting arm. This gas flow separation is caused by adverse pressure gradients due to the forced shaping of the split stream around the core member. The flow turbulence at region of feedstock injection introduces non-axial velocity vectors causing random feedstock trajectories, resulting in molten feedstock adhering to, and solidifying on the internal wall of the output nozzle with the consequent malfunctioning of the spraying process. These phenomena are shown schematically in FIG. 2.1 and FIG. 2.2 of the drawings. FIG. 2.1 for example, shows the two opposed cross-sectional flow gradients induced within each plasma channel due to the kidney shaped flow around and about the central core member. The effects are as follows: a) plasma gas turbulence due to the opposing directions of the flow and the counter-flow gradients induced within each converging channel (only one type of flow gradient is shown in each channel in FIG. 2.1) and b) plasma gas turbulence due to the gas flow separating (detaching) from the splitting arms and core surfaces. Consequently, the feedstock is injected into a non-laminar and turbulent flow, resulting in at least some percentage of the feedstock particles attaining non-axial trajectories. This directs a portion of the feedstock particles towards the inner wall of the output nozzle, resulting in the build up of molten deposits on the inner wall of the output nozzle and possibly on the feedstock injection tip itself. The nozzle build-up phenomenon is shown schematically in FIG. 2.2.

This "kidney shape effect" can be reduced to some degree in Delcea '391 by providing an increased plurality of plasma channels as shown schematically in FIG. 2.3 of the drawings. For example, if six or more channels were provided, their cross-sections would shrink to become more or less circular or slightly oval. This approach would result in a proportionate increase in the number of splitting arms as well as an increase in the total surface area of the internal pathways exposed to the hot gas. Consequently, the conduction heat losses would also increase accordingly, therefore rendering the injector thermally inefficient.

One way of partially addressing the problems in the torch of Delcea '391 while using only two plasma channels is as shown in U.S. Pat. No. 6,202,939 of Delcea. Delcea '939 also provides a core member and two connecting arms, with the core being encircled by two kidney shaped channels. Two small holes are provided in the core diverting a small portion of the gas stream into the feedstock input channel to increase the axial injection effect and therefore to overcome some of the flow turbulence generated at the region of feedstock injection.

In the case of thermal spray torches, it is common practice to attach a flow expansion output nozzle in order to increase feedstock velocity and the transfer of heat to the feedstock. As a general rule, the longer the output nozzle the more heat and velocity is transferred from the gas stream to the feedstock and therefore denser thermal spray coatings can be obtained. One of the main factors that limit the length of the output nozzle is the trajectory of the molten feedstock along the nozzle passage. If the injection of the feedstock is such that at least some of the feedstock will deviate towards the internal wall of the nozzle solidifying and building up on the cold surface of the wall it will result in the malfunctioning of the spray torch.

One of the most significant problems affecting the prior art single stream plasma torches with axial injection is "spitting" due to the turbulent contacting of the feedstock by the gas streams. "Spitting" is a periodic burst of released feedstock from the outlet end of the torch when some feedstock which has solidified on the internal pathways of the torch such as on the output nozzle inner wall or on the feedstock injection tip is subsequently remelted by the heated gas and periodically released as relatively large droplets, which become incorporated within the sprayed coating as structural defects.

It would be desirable to provide a superior feedstock injector for attachement to a single stream thermal spray torch, the injector providing for a simplified as well as optimized mechanism for splitting and shaping the single stream with reduced turbulence resulted from the interaction between the stream and the internal pathways of the injector. There is a need for a superior feedstock injector having its internal pathways shaped so as to provide a single step, streamlined splitting mechanism wherein a single gas stream is split in the least intrusive and least turbulent manner, to minimize gas turbulence at the feedstock injection region and to provide an uniform contact of the feedstock with the gas stream.

BRIEF SUMMARY OF THE INVENTION

The present invention provides an axial feedstock injector having an innovative internal configuration that provides a substantially improved gas flow through the injector.

BRIEF DESCRIPTION OF THE DRAWINGS

Further features and advantages will be evident from the following detailed description of the preferred embodiments of the present invention and in conjunction with the accompanying drawings, in which:

FIG. 1 is a schematic of the gas flow principles within a prior art injector according to U.S. Pat. No. 4,780,591 of Bernecki et al.;

FIG. 2.1 is a is a schematic of the gas flow principles within a prior art injector according to U.S. Pat. No. 5,420,391 of Delcea;

FIG. 2.2 is a schematic of feedstock trajectories within an output nozzle attached to a prior art injector according to U.S. Pat. No. 5,420,391 of Delcea;

FIG. 2.3 is a schematic of a prior art injector according to U.S. Pat. No. 5,420,391 of Delcea, showing a plurality of six channels arranged around a core member;

FIG. 5.1 is a schematic isometric view of a cross-section taken along line 5—5 in FIG. 3 and showing a preferred embodiment of the splitting arm;

FIG. 5.2 is a schematic isometric view of a cross-section taken along line 5—5 in FIG. 3 and showing an alternate preferred embodiment of the splitting arm;

FIG. 5.3 is a schematic isometric view of a cross-section taken along line 5—5 in FIG. 3 and showing another alternate preferred embodiment of the splitting arm;

FIG. 5.4 is a schematic isometric view of a cross-section taken along line 5—5 in FIG. 3 and showing yet another alternate preferred embodiment of the splitting arm;

FIG. 5.5 is a schematic isometric view of the splitting arm of FIG. 5.2 showing the gas flow path around the splitting arm;

DETAILED DESCRIPTION OF THE INVENTION

Figure 3:
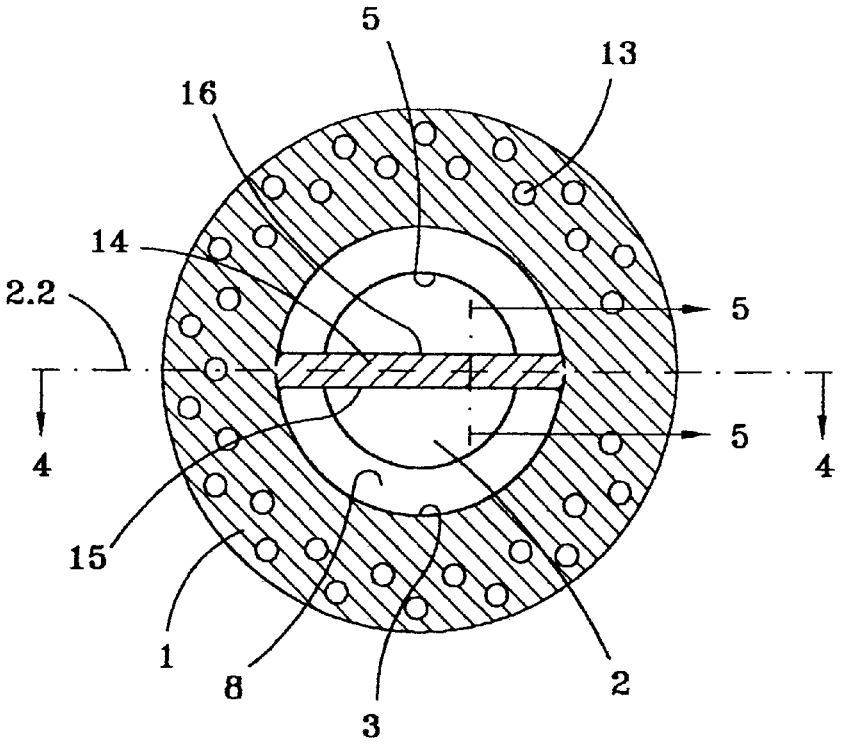
FIG. 3 is a top view of the feedstock injector of the present invention taken in cross-section along line 3—3 in FIG. 4.
Figure 4:
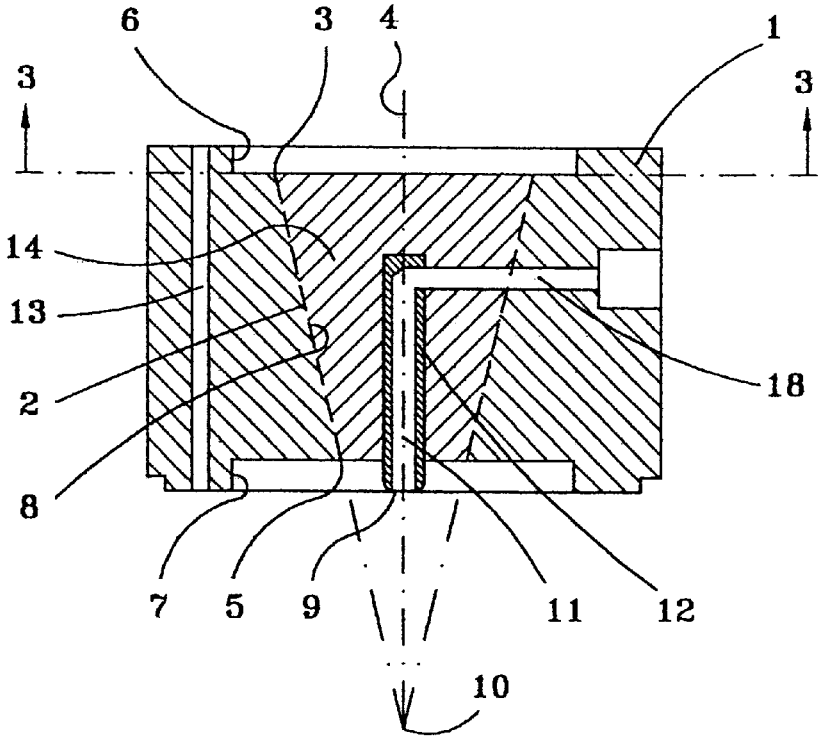
FIG. 4 is a schematic front elevation view of the feedstock injector of the present invention taken in cross-section along line 4—4 in FIG. 3.

Referring initially to FIG. 3 and FIG. 4 of the drawings, the feedstock injector is shown having a body 1 and a longitudinal axis 4. Passages 13 are shown provided in body 1 for passing a suitable cooling agent. Any other conventional means of cooling the feedstock injector body may also be employed such as longitudinal outer perimeter grooves or indirect type, contact cooling. Preferably, the injector should be made of a material having good thermal conductivity. Conventional materials are for example copper or copper alloys. A suitable cavity 6 may be shaped at the inlet end of the body 1 in order to facilitate the connection to the output of a plasma generator such as a plasmatron or to other sources of heated gas such as a fuel combustion chamber. Similarly, a suitable cavity 7 may be shaped at the outlet end of the body 1 in order to facilitate the attachment of an output spray nozzle. One preferred plasmatron is disclosed in U.S. Pat. No. 6,114,649 of Delcea that provides for a stabilized electric arc and the generation of a consistent, higher ionized and higher enthalpy plasma stream. Any other types of plasmatrons may also be used in conjunction with the present feedstock injector. A converging channel 2, coaxial with the longitudinal axis 4, has a frustro-conical jet-shaping wall 8 extending from the inlet end 3 to the outlet end 5 of injector 1 and converging towards a point of convergence 10 located on the longitudinal axis 4 downstream of the outlet end. A splitting arm 14 extends inside converging channel 2 bridging diagonally from opposed locations on wall 8 and extending longitudinally from the inlet end 3 to the outlet end 5. Arm 14 is shown in FIG. 2 as being a separate component therein, however it may also be machined directly into injector body 1. Two opposed surfaces or walls 15 and 16 substantially define splitting arm 14, as best seen in FIG. 5.1. Surfaces 15 and 16 are disposed symmetrically with respect to an imaginary splitting arm plane 2.2 incorporating line 4—4 in FIG. 1. The intersection of surfaces 15 and 16 and any sectional plane perpendicular to the longitudinal axis 4 results in two opposed lines equally distanced from the splitting arm plane 2.2. Consequently, unlike in the relevant prior art, surfaces 15 and 16 do not define a central core member there between. One or more feedstock supply passages lead from the outer surface of the injector toward axis 4 and open into a feedstock input passage 11, which is coaxial with axis 4. Conventionally, an injection tip 9 may be provided, extending coaxially with the feedstock supply passage 11 at the downstream end of arm 14. Since some feedstock materials are hard and abrasive therefore tending to wear out the wall and therefore increase the cross-section of feedstock input passage 11, an abrasion resistant sleeve or lining 12 may be provided in arm 14 by any suitable engineering method. If desired, a similar abrasion resistant sleeve or lining may be also provided to protect the feedstock supply passages 18.

Arm 14 splits channel 2 into two equal and opposed converging channels having opposed and substantially semicircular cross-sections. The two semicircular converging channels are disposed symmetrically with respect to splitting arm plane 2.2. Surfaces 15 and 16 should be shaped such as to minimize the flow turbulence induced by the splitting action of the arm. One innovative way of achieving this result is by applying to arm 14 an aerodynamically streamlined shape. In this respect, some practical ways for shaping arm 14 are shown schematically in FIGS. 5.1, 5.2, 5.3 and 5.4. The numerical references in FIGS. 5.1, 5.2, 5.3 and 5.4 are the same like the corresponding numerical references in FIG. 3 and FIG. 4 except as may be modified in the subsequent paragraphs.

FIG. 5.1 shows one preferred embodiment of arm 14. Surfaces 15 and 16 are shown as two convex surfaces simulating a symmetrical airfoil at "zero angle of attack". Arm 14 has a maximum cross-sectional thickness "$t_{max}$" and a chord length "c". According to the fluid mechanics theory applicable to streamlined bodies and airfoil profiles, thickness ratio "$t_{max}/c$" is an important fluid dynamics parameter and in a preferred embodiment it should be between about 0.15–0.4. If desired, one or more passages 19 can be provided across the upper portion of splitting arm 14 for passing a fluid coolant.

FIG. 5.2 and FIG. 5.3 show two alternate embodiments of splitting arm 14 comprising two possible approximations of a streamlined shape, easier to achieve by way of more conventional machining techniques. For example, FIG. 5.2 shows arm 14 having opposed planar surfaces 15 and 16 parallel with each other and parallel with the splitting arm plane 2.2. For flow dynamics considerations, surfaces 15 and 16 are shown being closed at their upstream ends by an upstream wall 17 curved convexly and closed at their downstream ends by a downstream wall 20 having a wedge shape with its apex in the downstream direction. Walls 17 and 20 are symmetrical with respect to the splitting arm plane 2.2. Arm 14 has a maximum cross-sectional thickness "$t_{max}$" and a chord length "c". In a preferred embodiment thickness ratio "$t_{max}/c$" of arm 14 should be between about 0.15–0.4. FIG. 5.3 shows arm 14 comprising opposed surfaces 15 and 16 converging towards each other in the downstream direction, their full convergence being aided by a downstream wedge shaped wall 20 similar to the one described with reference to FIG. 5.2. Similarly to the embodiment depicted in FIG. 5.2, a convexly curved wall 17 is shown closing surfaces 15 and 16 at their upstream ends. The convexly curved wall 17 sometimes referred to as a "C" type section has an approximate drag coefficient of about 1.2 for a Reynolds number Re>1000 and could be replaced with any other suitable profiles that would further minimize the impact between a gas stream and the upstream end of splitting arm 14. For example, instead of "C" type section a wedge shaped wall 17 could be used having a drag coefficient of possibly less than 1.2. Arm 14 in FIG. 5.3 has a maximum cross-sectional thickness "$t_{max}$" near its upstream end and a chord length "c". In a preferred embodiment, thickness ratio "$t_{max}/c$" of arm 14 should be between about 0.15–0.4.

FIG. 5.4 shows an alternate embodiment of surfaces 15 and 16, each having additional convex curvatures 26 symmetrically disposed with respect to the splitting arm plane 2.2 and axis 4. These additional curvatures cause some axial wrapping of the split flows but without the turbulence otherwise induced by the presence of a core element.

If the upstream end of arm 14 is shaped to approximate the surface of an elongated cylindrical or oval body by way of a convex and symmetrical wall, it could facilitate the occurrence of the "Coanda Effect". At its broadest level, the Coanda phenomenon can be defined as the deflection of streams by solid surfaces. If certain surface shape conditions are provided, flows have a tendency to become attached to and therefore flow around a solid surface contacted by the flow. As shown schematically in FIG. 5.5, the occurrence of the "Coanda Effect" results in a the gas flow 22 attaching to the surface of upstream wall 17, thus reducing the turbulence caused by the impact of the gas stream with the upstream end of arm 14. What is achieved with arm 14 as shown in FIG. 5.5, is in essence the effect of a streamlined body fully immersed in a gas flow as explained further below. The single stream of gas 21 impacts arm 14 at its upstream end shown as a convexly shaped transversal wall 17 and, according to the "Coanda Effect", the split streams attach to the opposite sides of wall 17 as indicated at numeral 22 in FIG. 5.4. Because no additional surface profiles such as a core member are shaped into surfaces 15 and 16, no adverse pressure gradients are generated. Consequently, the streams 23 on each opposite side of arm 14 continue to flow forward with reduced turbulence and remain attached to or alternatively flow close to surfaces 15 and 16 due to the "Coanda Effect". Flows 24 on each opposite side of arm 14 follow the shape of the wedge shaped downstream wall 20 and merge together into a single stream 25 having reduced turbulence. Consequently, if a tip 9 is provided to inject feedstock axially, the tip becomes immersed in the single gas stream and the gas contacts the injected feedstock with improved uniformity.

Figure 6:
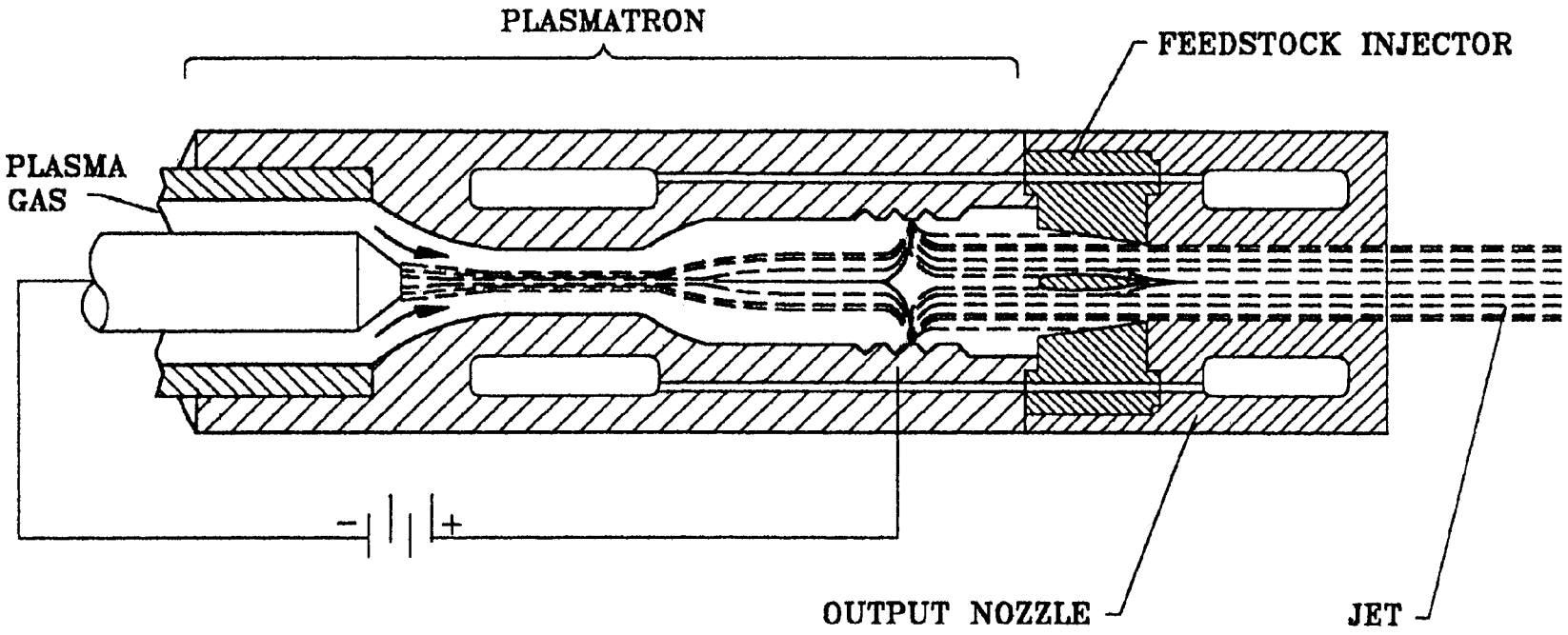
FIG. 6 is a schematic side view of a plasma spray torch taken in cross-section incorporating one embodiment of the feedstock injector of the present invention.

One example of practical use of the present invention is shown schematically in FIG. 6 wherein the feedstock injector is shown incorporated schematically into a plasma spray torch apparatus. A plasma generator, such as a plasmatron is attached at the upstream end of the feedstock injector. A preferred plasmatron that can be used with the present feedstock injector is disclosed in U.S. Pat. No. 6,114,649 of Delcea, which provides for a stabilized electric arc operation and the issuance of a higher ionized and higher enthalpy plasma jet. In FIG. 6 the plasma stream is split by the splitting arm in two opposed streams flowing with reduced turbulence about the opposed surfaces of the splitting arm. Feedstock such as a powder is injected axially through a feedstock injection passage (not shown in FIG. 6 for simplicity purposes). A flow expansion output nozzle is shown schematically attached to the downstream cavity of the feedstock injector. The output nozzle has its inlet shaped to receive the merged gas streams and the entrained feedstock. The gas flows around the feedstock stream with highly reduced turbulence, leading to the uniform contacting of the feedstock. Consequently, the feedstock mixes with the gas and travels substantially axially along the bore of the output nozzle. By using the feedstock injector of the present invention, the feedstock axial velocity, axial trajectory and the mixing of the feedstock with the gas stream are improved over the prior art, resulting in improved functioning of the thermal spraying torch and the production of significantly improved thermal spray coatings.

Practical experiments using the present feedstock injector resulted in the issuance of a plasma jet that exhibited improved gas flow characteristics even at distances of about 5–6 inches (about 127–152 mm) from the exit of the output nozzle. Usually, as the plasma stream exits the nozzle, its fringes are quite turbulent therefore entraining the surrounding air quite rapidly. This unwanted phenomenon appeared significantly reduced when using the present feedstock injector. When injecting feedstock through the present injector, no spitting occurred. Also, longer axial trajectories and higher velocity were obtained for the molten feedstock particles, therefore increasing the plasma spray deposit and target efficiency and the plasma spray coating density and uniformity. Deposit efficiency, sometimes referred to as "DE", is generally defined as the percentage of the feedstock material fed into the thermal spray apparatus that actually deposits on the sprayed part. The balance of feedstock receives insufficient heat or momentum, bounces off the spray target without adhering to it and is therefore lost to the spray process. A low deposit efficiency results in increased costs and may even render the entire spray process non economical or non competitive. In further experiments using the feedstock injector of the present invention, high deposit efficiency of over 90% was measured for certain expensive feedstock materials such as the Abradable Spray Powder, which is a type of feedstock widely sprayed in the aerospace industry with a deposit efficiency reported by one manufacturer Sulzer-Metco, as being between 30–40%. This particular type of feedstock has very low density and is therefore sensitive to gas flow turbulence at the region of injection. Most of the prior art devices inject this feedstock externally in order to avoid nozzle spitting but external injection generally leads to low deposit efficiency. Plasma spraying of abradable feedstock materials with prior art devices with axial injection, such as the prior art plasma torch described in U.S. Pat. Nos. 4,780,591 of Bernecki et al. and 5,420.391 of Delcea, would lead to relatively rapid feedstock build-up on the injection tip and on the output nozzle, which would in turn result in spitting. Longer spraying times with some minor nozzle build-up were achieved for a similar abradable feedstock material when using a device built in accordance with U.S. Pat. No. 6,202,939 of Delcea. However, a significant improvement was noticed when using the feedstock injector of the present invention.

Metallic, alloys and cermet feedstock powders were test sprayed using the feedstock injector of the present invention. Longer molten particle trajectories were noticed, indicative of increased velocity and improved melting. Less divergent trajectories were also observed, indicating improved axiality, believed to be due to the less turbulent contacting of the feedstock stream by the plasma jet. For example, when 80/20 Ni/Cr feedstock was injected using the present injector, a steam of molten feedstock was observed being confined within a relatively narrow beam having a length of approximately 2 meters (approximately 79 inches). The divergence of the molten feedstock beam at such great distance appeared to be noticeably less than in the case of known prior art injectors. This significant improvement is attributed mostly to the less turbulent gas flow through the injector and the more uniform contacting of the feedstock by the gas stream, as provided by the injector of the present invention.

Thermal efficiency of plasma or thermal jet devices is generally defined as the percentage of the energy left in the gas stream after deducting the energy portion that is lost to the coolant. One handy method of calculating thermal efficiency is to monitor the coolant flow as well as its input and output temperatures. This data enables to calculate the energy transmitted from the gas stream to the coolant and therefore lost from the useful spray process. In the case of axial feedstock injectors, the gas heat losses occur by radiation, convection and conduction through the surfaces of the injector internal pathways. An increased surface area exposed to the hot gas stream would increase the heat losses. Concurrently, flow turbulence increases even further the heat losses. By having only one streamlined splitting arm opposing the stream, and by reducing the gas turbulence commonly associated with splitting, the feedstock injector of the present invention is estimated to be about 15–20% more thermal efficient than other injectors described in the relevant prior art. This gain in thermal efficiency leaves more heat into the jet, which contributes to the higher spray rates, higher deposit efficiency and better feedstock melting achievable with the injector of the present invention.

Having described the embodiments of the invention, modifications will be evident to those skilled in the art without departing from the scope and spirit of the invention as defined in the following appended claims.

I claim:

1. A feedstock injector for axial injection of feedstock into the stream of gas of a spray torch, the injector having a longitudinal axis and comprising:

(a) an inlet end for receiving the stream of gas at an upstream end of the injector;

(b) an outlet end to discharge the stream of gas at a downstream end of the injector;

(c) a converging channel co-axial with the longitudinal axis having a frustroconically shaped wall extending between the inlet and outlet ends and converging downstream of the outlet end toward a point of convergence on the longitudinal axis;

(d) a splitting arm extending from a first region of the wall of the converging channel to a second region opposite to the first region, the arm comprising a pair of opposed surfaces, arranged symmetrically with respect to a splitting arm plane which includes the longitudinal axis, and extending in a direction between the inlet and outlet ends; and (e) a feedstock passage passing through the splitting arm, the passage having an outlet end directed toward the point of convergence for directing feedstock axially in a downstream direction from the outlet end.

2. The injector of claim 1 wherein the surfaces are parallel with each other.

3. The injector of claim 1 wherein the surfaces are angled to converge toward one another in the downstream direction to form a wedge shaped splitting arm.

4. The injector of claim 1 wherein the surfaces are planar.

5. The injector of claim 4 wherein the surfaces are parallel with one another.

6. The injector of claim 4 wherein the surfaces are angled to converge toward one another in the downstream direction to form a wedge shaped splitting arm.

7. The injector of claim 1 wherein the surfaces are curved convexly.

8. The injector of claim 7 wherein the maximum outward extent of the surfaces is in a region of the surfaces closer to the inlet end than the outlet end.

9. The injector of claim 1 wherein the splitting arm further comprises an upstream wall joining the upstream ends of the surfaces.

10. The injector of claim 9 wherein the upstream wall is curved convexly.

11. The injector of claim 10 wherein the upstream wall is symmetrical with respect to the splitting arm plane.

12. The injector of claim 9 wherein the upstream wall is wedge shaped with the apex in the upstream direction.

13. The injector of claim 12 wherein the upstream wall is symmetrical with respect to the splitting arm plane.

14. The injector of claim 1 wherein the splitting arm further comprises a downstream wall joining the downstream ends of the surfaces.

15. The injector of claim 14 wherein the downstream wall is curved convexly.

16. The injector of claim 15 wherein the downstream wall is symmetrical with respect to the splitting arm plane.

17. The injector of claim 14 wherein the downstream wall is wedge shaped with the apex in the downstream direction.

18. The injector of claim 17 wherein the downstream wall is symmetrical with respect to the splitting arm plane.

19. The injector of claim 9 wherein the splitting arm further comprises a downstream wall joining the downstream ends of the surfaces.

20. The injector of claim 10 wherein the splitting arm further comprises a downstream wall joining the downstream ends of the surfaces and wherein the downstream wall is curved convexly.

21. The injector of claim 11 wherein the splitting arm further comprises a downstream wall joining the downstream ends of the surfaces and wherein the downstream wall is curved convexly and wherein the downstream wall is symmetrical with respect to the splitting arm plane.

22. The injector of claim 12 wherein the splitting arm further comprises a downstream wall joining the downstream ends of the surfaces and wherein the downstream wall is wedge shaped with the apex in the downstream direction.

23. The injector of claim 13 wherein the splitting arm further comprises a downstream wall joining the downstream ends of the surfaces and wherein the downstream wall is wedge shaped with the apex in the downstream direction and wherein the downstream wall is symmetrical with respect to the splitting arm plane.

24. A feedstock injector as described in claim 1 wherein the thickness to length ratio "$t_{max}/c$" of the splitting arm measured in a cross-section taken at the maximum distance between the surfaces is between 0.15–0.4.

25. A feedstock injector as described in claim 7 wherein the thickness to length ratio "$t_{max}/c$" of the splitting arm measured in a cross-section taken at the maximum outward extent of the surfaces is between 0.15–0.4.

* * * * *